US005890356A

United States Patent [19]

Stahlecker

[11] Patent Number: 5,890,356

[45] Date of Patent: Apr. 6, 1999

[54] OPEN-END FIBER VEIL SPINNING APPARATUS AND METHOD

[75] Inventor: Fritz Stahlecker, Josef-Neidhart-Strasse 18, 73337 Bad überkingen, Germany

[73] Assignees: Fritz Stahlecker, Bad Ueberkingen; Hans Stahlecker, Suessen, both of Germany

[21] Appl. No.: 815,459

[22] Filed: Mar. 11, 1997

[30] Foreign Application Priority Data

Mar. 20, 1996 [DE] Germany ..... 196 10 960.4

[51] Int. Cl.[6] ..... D01H 4/00

[52] U.S. Cl. ..... 57/401; 57/403; 57/408; 57/409; 57/411; 57/412

[58] Field of Search ..... 57/400, 401, 403, 57/404, 408, 409, 411, 412

[56] References Cited

U.S. PATENT DOCUMENTS

| | | | |
|---|---|---|---|
| 4,169,348 | 10/1979 | Blackburn | 57/408 |
| 4,697,409 | 10/1987 | Handschuch et al. | 57/401 |
| 4,724,668 | 2/1988 | Wassenhoven | 57/400 |
| 4,753,066 | 6/1988 | Briner et al. | 57/401 |
| 5,187,930 | 2/1993 | Stahlecker | 57/403 |
| 5,222,352 | 6/1993 | Stahlecker | 57/412 |

FOREIGN PATENT DOCUMENTS

4040102A1 6/1992 Germany .

*Primary Examiner*—William Stryjewski
*Attorney, Agent, or Firm*—Evenson McKeown Edwards & Lenahan, PLLC

[57] ABSTRACT

In a process for open-end spinning at least one sliver is opened to single fibers, which form a fiber veil. The single fibers are fed to a rotating collecting surface which is driven transversely to their travel direction, and are withdrawn from the collecting surface in the form of a yarn with twist along a yarn formation line before the completion of one single revolution of the collecting surface. The single fibers are never slowed down at any point in the sliver-to-yarn process. Immediately after their separation from the sliver, the single fibers are subjected to an exactly predetermined, mechanically controlled speed.

30 Claims, 11 Drawing Sheets

OPEN-END FIBER VEIL SPINNING APPARATUS AND METHOD

BACKGROUND AND SUMMARY OF THE INVENTION

This application claims the priority of Germany application 196 10 960.4, filed in Germany on Mar. 20, 1996, the disclosure of which is expressly incorporated by reference herein.

The present invention relates to a process for open-end spinning in which at least one sliver is opened to single fibers which form a fiber veil, and in which these single fibers are fed to a rotating collecting surface which is driven transversely to their travel direction, and are withdrawn from the collecting surface in the form of a yarn with twist along a yarn formation line before the completion of one single revolution of the collecting surface, whereby the single fibers are never at any point slowed down in the sliver-to-yarn process.

In a process of this type (U.S. Pat. No. 5,222,352), an opening roller, known from rotor spinning, serves to open the sliver to single fibers, and from which the single fibers are transported through a fiber feed channel in an air-stream to a front surface of a rotating disc. In the case of these types of opening rollers, the fibers usually enter the fiber feed channel at a speed which corresponds to approximately half the speed of the opening roller. The single fibers are then accelerated again in the fiber feed channel. The speed of the single fibers when they reach the rotating disc is therefore very high, whereby the actual acceleration of the single fibers is also unknown. The result is that all spinning elements arranged downstream must have an even higher effective speed, which reaches dimensions which are then normally no longer controllable.

An attempt was made in a similar process (German published patent application 40 40 102) to keep the withdrawal speed down by driving the opening roller at a reduced circumferential speed. This appears to be possible in that the opening roller comprises on its periphery, in addition to its combing structure in the form of teeth or needles, suction openings, which suck the sliver deep into the combing structure and, despite a reduced speed, ensure a good combing effect.

However, by means of the suction of the single fibers, they are transported practically at the circumferential speed of the opening roller, so that the single fibers, despite the reduced circumferential speed of the opening roller, have at least the same speed as in the case of standard opening rollers. In this case a fiber feed channel acting as an additional acceleration channel is also arranged downstream of the opening roller.

It is an object of the present invention to improve a process of the type mentioned above to the extent that the single fibers arrive at the collecting surface at a sufficiently low speed to make the yarn withdrawal speed still controllable in its order of magnitude.

This object has been achieved in accordance with the present invention in that the single fibers are subjected to an exactly predetermined, mechanically controlled speed directly after their separation from the sliver.

The present invention is based on the fact that the single fibers, after their separation from the sliver, are not immediately brought up to their high speed by the combing structure of the opening roller, but rather first must be accelerated from the feed speed to the transport speed. The present invention utilizes these circumstances in that the single fibers opened from the sliver are immediately taken up by the collecting surface, which runs at a controlled, sufficiently low speed, before the single fibers reach an excessive speed. To this end, the collecting surface is disposed in sufficiently close proximity to the combing zone, so that the single fibers reach the collecting surface immediately after being combed from the sliver.

The single fibers are advantageously taken up by a suction transport surface directly after they are combed from the sliver. The suction not only serves to transport the single fibers practically slip-free, but also to ensure that the single fibers are removed quickly and efficiently from the opening device, for example from the combing structure of an opening roller, and fed to the transport surface.

In one embodiment, the transport surface can take over the function of the collecting surface at the same time. In another embodiment the single fibers can be transferred from the transport surface to a separate collecting surface. In the former case, the construction is simpler, in the latter case the single fibers are subjected again to a subsequent drafting before they are spun in into the yarn.

In further embodiments, the circumferential direction of the collecting surface is at least approximately perpendicular to the moving direction of the fiber veil occurring thereon. This results in the single fibers obtaining maximum staggering in a transport direction along the transport surface, whereby any eventual drafting errors caused by the opening device are lessened in their effect.

The spun yarn can be withdrawn from the collecting surface in various directions. In one process, the yarn is withdrawn tangentially to the circumferential direction of the collecting surface. Thus a further directional change is avoided. In another process, the yarn is withdrawn transversely to the circumferential direction of the collecting surface. This results in the collecting surface participating in twisting the yarn.

In a further embodiment, the yarn is withdrawn from the collecting surface immediately after the fiber veil has reached the collecting surface. Thus longer transport paths on the collecting surface are avoided, so that, if required, a plurality of opening devices can be arranged at a single collecting surface.

For carrying out the process, the collecting surfaces can have various forms. In one embodiment, the surface of an air-permeable suctioned sieve belt is provided as a collecting surface. In another embodiment, an air-permeable suctioned ring surface on the front side of a rotating disc is provided as a collecting surface. In a further embodiment, an air-permeable, suctioned circumferential surface of a roller-like rotating disc is provided as a collecting surface. It is important in especially preferred embodiments that the circumferential speed of the collecting surface is greater than the speed of the single fibers at the instant they arrive at the collecting surface, but is slower than the withdrawal speed.

A transfer roller can be arranged upstream of the collecting surface, the moving direction of which transfer roller is transverse to the circumferential direction of the collecting surface. This transfer roller takes up the single fibers directly after they have been opened from the sliver and guides them at a controlled, sufficiently low speed to the collecting surface. The collecting surface has at least the same speed or a slightly higher one than the transfer roller.

The collecting surface can be bordered by lateral guiding surfaces for the above purpose. This means that at the generally rather high transport speeds, the single fibers are prevented from leaving the collecting surface laterally. The collecting surface can be provided with a perforation, in the form of slits disposed transversely to the circumferential direction. Thus, there is no area, as seen in the effective width of the collecting surface, which is not suctioned.

In all cases, an air nozzle, in extension of the yarn formation line, can be arranged downstream of the collecting surface. This air nozzle functions as the actual twist device, while the collecting surface, as required or desired, provides only a slight pre-twist of the yarn.

These and further objects, features and advantages of the present invention will become more readily apparent from the following detailed description thereof when taken in conjunction with the accompanying drawings wherein:

DETAILED DESCRIPTION OF THE DRAWINGS

Figure 1:
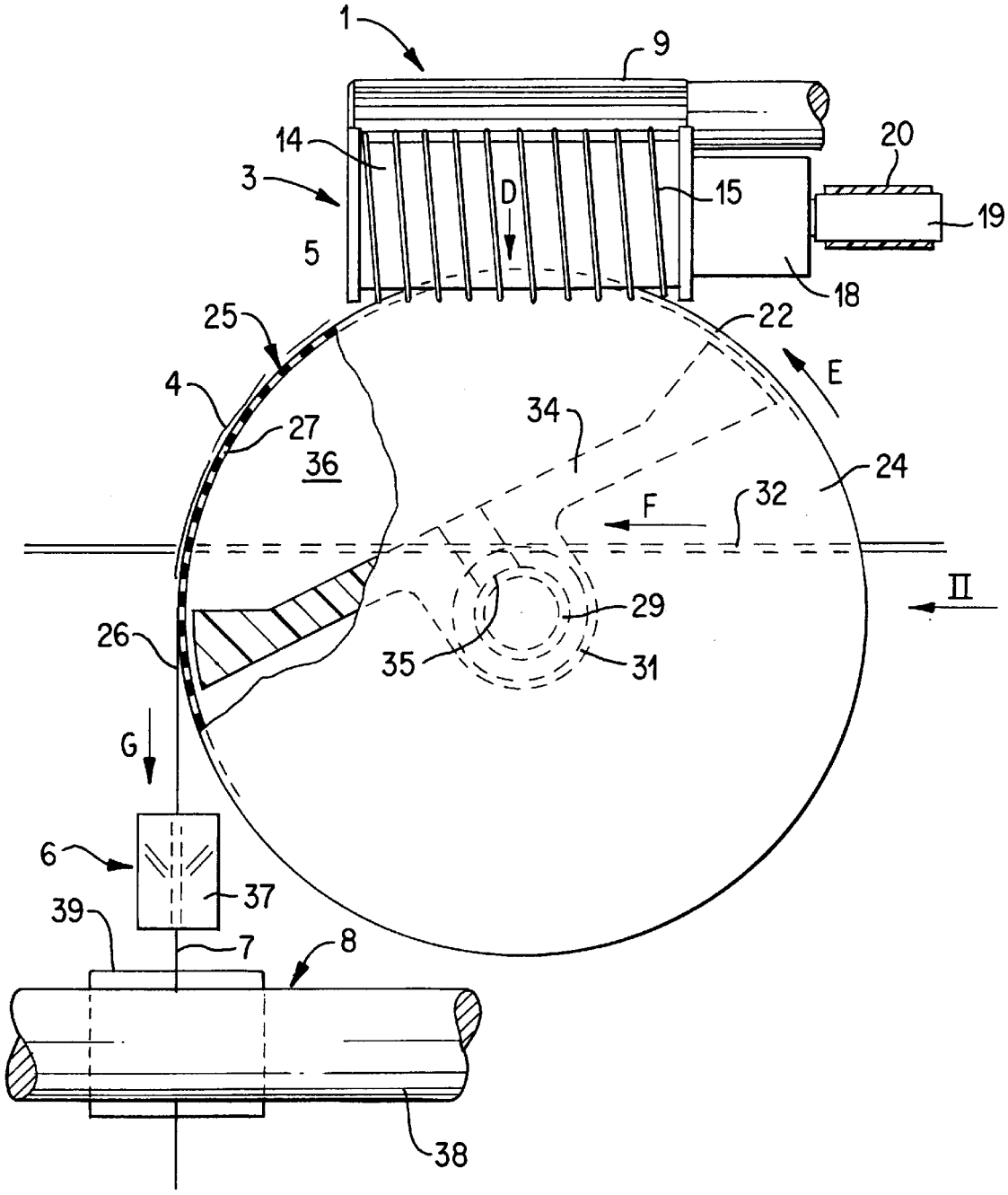
FIG. 1 is a part sectional view of a device, as seen in arrow direction I on FIG. 2, for carrying out a process for open-end spinning according to a preferred embodiment of the present invention.
Figure 2:
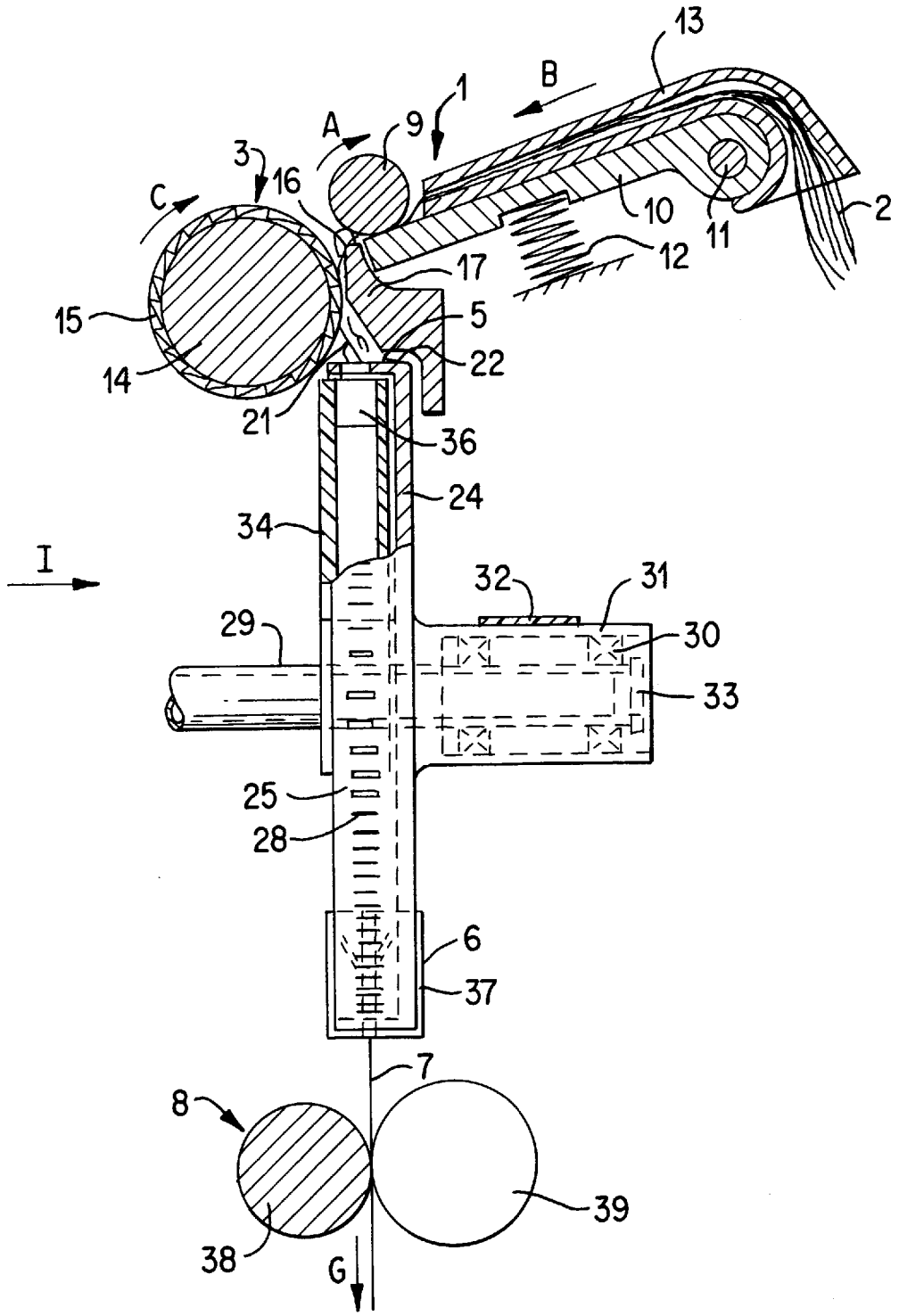
FIG. 2 is a view of the device as seen in arrow direction II of FIG. 1.

The device in FIGS. 1 and 2, with which the process according to the present invention can be carried out, comprises a feed device 1 for a very wide sliver 2 or for a plurality of adjacently arranged slivers 2, an opening device 3 for opening the single fibers 4 from the at least one sliver 2, a rotating collecting surface 5, a twist device 6 for twisting the yarn 7 to be spun, and a withdrawal device 8 for withdrawing the yarn 7. A winding device arranged downstream is not shown.

The feed device 1 comprises a very wide feed roller 9, whose effective width is adapted to the width of the at least one sliver 2 and which is driven in rotational direction A. A feed table 10 operates with the feed roller 9, and they form between them, in a known way, a nipping point for the sliver 2. The feed table 10 can be pressed against the feed roller 9 around a swivel axle 11 by means of a weighting spring 12. The sliver 2 is fed through a feed condenser 13, arranged upstream, to the above named nipping point in feed direction B.

The opening device 3 comprises an opening roller 14 driven in rotational direction C, that is, in the same direction as the feed roller 9, the periphery of the opening roller 14 being equipped with a saw-tooth or needle-like combing structure 15. The feed device 1 presents the rapidly rotating opening roller 14 an end of the sliver 1 in the form of a fiber beard 16, out of which the single fibers 4 are combed. The rear side of the fiber beard 16 is pressed to the combing structure 15 by means of a stationary fiber beard support 17.

The shaft of the opening roller 14 (not shown in detail) is supported in a bearing housing 18 and has a drive wharve 19 on the end facing away from the opening roller 14, which drive wharve 19 is driven by a drive belt 20.

The single fibers 4 opened from the fiber beard 16 form a fiber veil 21, which expands over the effective width of the opening roller 14 and at first has a moving direction D. This fiber veil 21 is fed to the collecting surface 5, which is formed by the circumferential surface 22 of a rotating roller-like disc 24.

The disc 24 rotates in circumferential direction E, whereby its axis is arranged perpendicular to the axis of the opening roller 14, without the two axes crossing. The circumferential direction E runs therefore transversely to the moving direction D of the single fibers 4 located in the fiber veil 21 The circumferential surface 22 of the disc 24 is in the form of a suctioned transport surface 25 for this fiber veil 21. The single fibers 4 are transported as far as a yarn formation line 26, which after a part of one revolution of the disc 24 of approximately 45°, adjoins the circumferential surface 22 in a tangential position.

The circumferential surface 22 is provided with a perforation 27, which takes the form of slits 28 disposed transversely to the circumferential direction E. A tube-like area 31 of the disc 24 is supported by means of bearings 30 on a vacuum suction tube 29. The tube like area 31 is driven by a drive belt 32. The drive belt 32 has a running direction F and can drive a plurality of discs 24.

The suction tube 29 is attached to a vacuum supply (not shown) and closed at one end with a sealing plug 33. The suction tube 29 is connected by means of a suction slit 35 with a suction area 36, which is defined by a suction insert 34 arranged on the suction tube 29. The suction area 36 extends from the area of the opening roller 14 to the beginning of the yarn formation line 26.

As can be seen, the circumferential direction E of the collecting surface 5 is perpendicular to the moving direction D of the fiber veil 21 occurring thereon. The disc 24 has a relatively large diameter, due to the wide effective width of the opening roller 14. The circumferential surface 22, which rotates past the opening roller 14, must be in a position to take up the whole fiber veil 21 which comes from the opening roller 14.

An air nozzle 37 is arranged downstream of the collecting surface 5 in extension of the yarn formation line 26, which air nozzle 37 essentially forms the twist device 6 and which imparts the necessary twist to the yarn 7. The air nozzle 37 concerned here is known in principle from pneumatic false twist spinning.

By means of the withdrawal device 8, the spun yarn 7 is withdrawn in tangential direction from the circumferential surface 22 of the disc 24 and fed in withdrawal direction G to a winding device (not shown). The withdrawal device 8 comprises a driven bottom roller 38, against which a top roller 39 is pressed in a flexible/resilient way.

With the above described device, a process for open-end spinning can be carried out, in which the single fibers 4, beginning with the sliver 2 and ending with the finished yarn 7, are never slowed down, but are rather, in the ideal case, even continuously accelerated somewhat. In order that the withdrawal speed of the withdrawal device 8 remains controllable, the single fibers 4 must be taken up by the collecting surface 5 before they are accelerated excessively by the opening roller 14. In consequence, the circumferential surface 22 of the collecting surface 5 is disposed very closely to the fiber beard 16, so that the collecting surface 5 can take up the opened single fibers 4 immediately and transport them on at an exactly predetermined and mechanically controlled speed.

Due to the wide effective width of the opening roller 14, an open fiber formation arises, which contains as many or more single fibers 4 as the finished yarn 7. In the circumferential direction E, a staggering of the single fibers 4 arises from the fiber veil 21, which staggering is still present in the yarn 7 during spinning in and which lessens the effect of any eventual drafting errors which may have occurred during the opening of the sliver 2.

As can be seen, the circumferential surface 22, which forms the outer lagging protective surface of the disc 24, can be proportionally narrow, as the single fibers 4 are disposed thereon in the form of a thin fiber veil 21. The narrow circumferential surface 22 can be further limited by lateral guiding surfaces in a way not shown in FIG. 2, but which are described with the aid of further Figures below.

In the embodiment according to FIGS. 1 and 2 the circumferential surface 22 of the disc 24 forms the transport surface 25 downstream of the opening roller 14 and also the collecting surface 5. As described below with the aid of further Figures, this is not compulsory.

In the embodiments described in the following, the same reference numbers are used as above, insofar as a component with the same function is concerned. A repeat description in each individual case can therefore be dispensed with.

Figure 3:
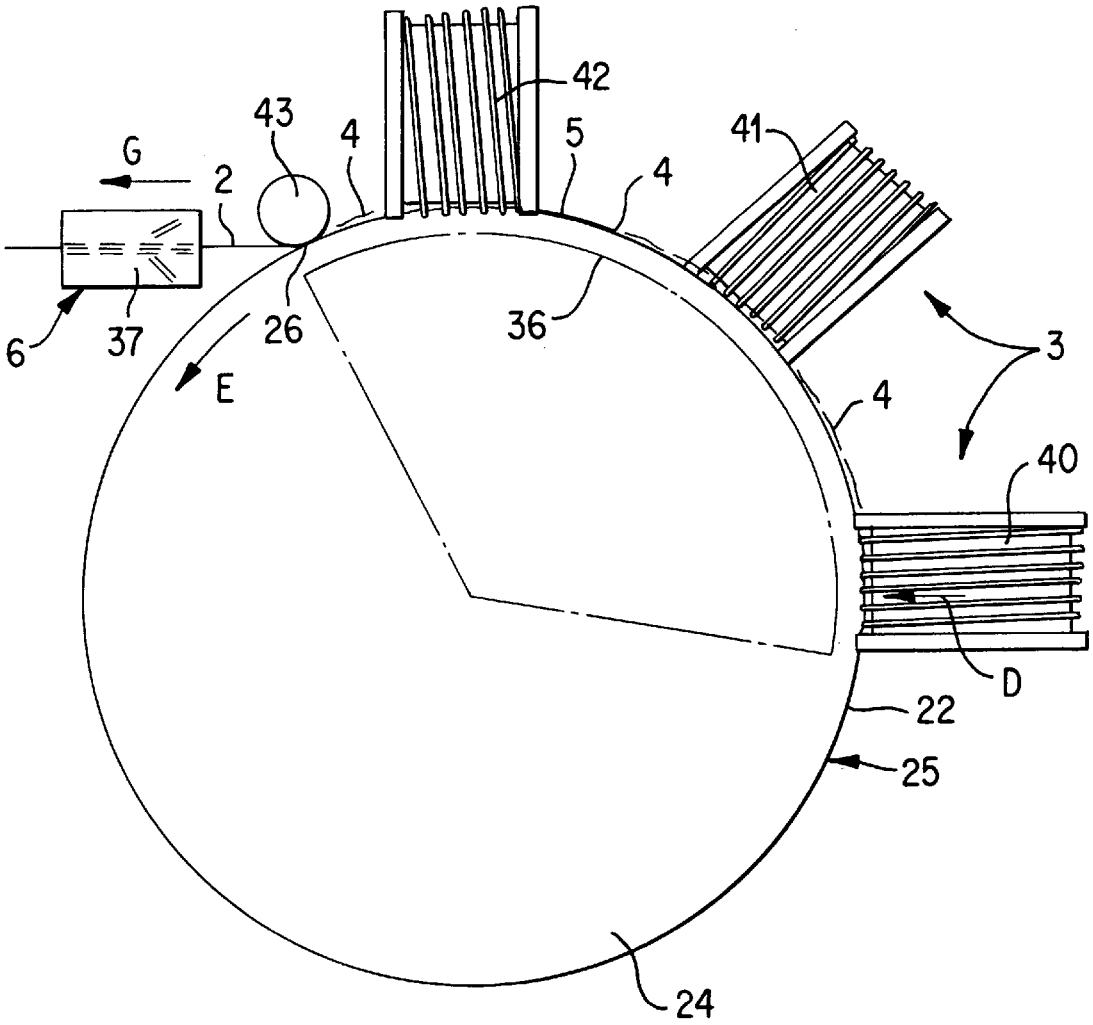
FIG. 3 is a view similar to FIG. 1, showing another embodiment of the present invention wherein three opening devices are arranged at a single collecting surface, to which opening devices a common yarn withdrawal device is arranged.

In the embodiment according to FIG. 3, the opening device 3 comprises three opening rollers 40,41 and 42 altogether, to which in each case—compared to FIG. 1—a relatively narrow sliver 2 is fed. The three opening rollers 40,41 and 42, as seen from the circumferential direction E of the collecting surface 5, are arranged closely one behind the other. The opening rollers 40,41 or 42 can be arranged somewhat laterally staggered to each other. From each opening roller 40,41 and 42, a fiber veil 21 comprising single fibers 4 reaches the circumferential surface 22, which serves as a suctioned transport surface 25 and which transports the single fibers 4 to a yarn formation line 26, where the yarn 7 is withdrawn in withdrawal direction G by a withdrawal device 8 (not shown). There, where the yarn formation line 20 begins, a lightly pressed on nipping roller 43 is disposed at the circumferential surface 22 of the roller-like disc 24.

In FIG. 3, the suction area 36 is denoted by a sector with dot-dash lines. It extends from the first opening roller 40 arranged in circumferential direction E to the nipping roller 43. As can be seen, the circumferential direction E runs transversely to the moving direction D of the single fibers 4 coming from the opening rollers 40,41, and 42. The single fibers 4, contained in the three fiber veils 21, comprise altogether as many single fibers 4 as the cross section of the yarn 7.

Figure 4:
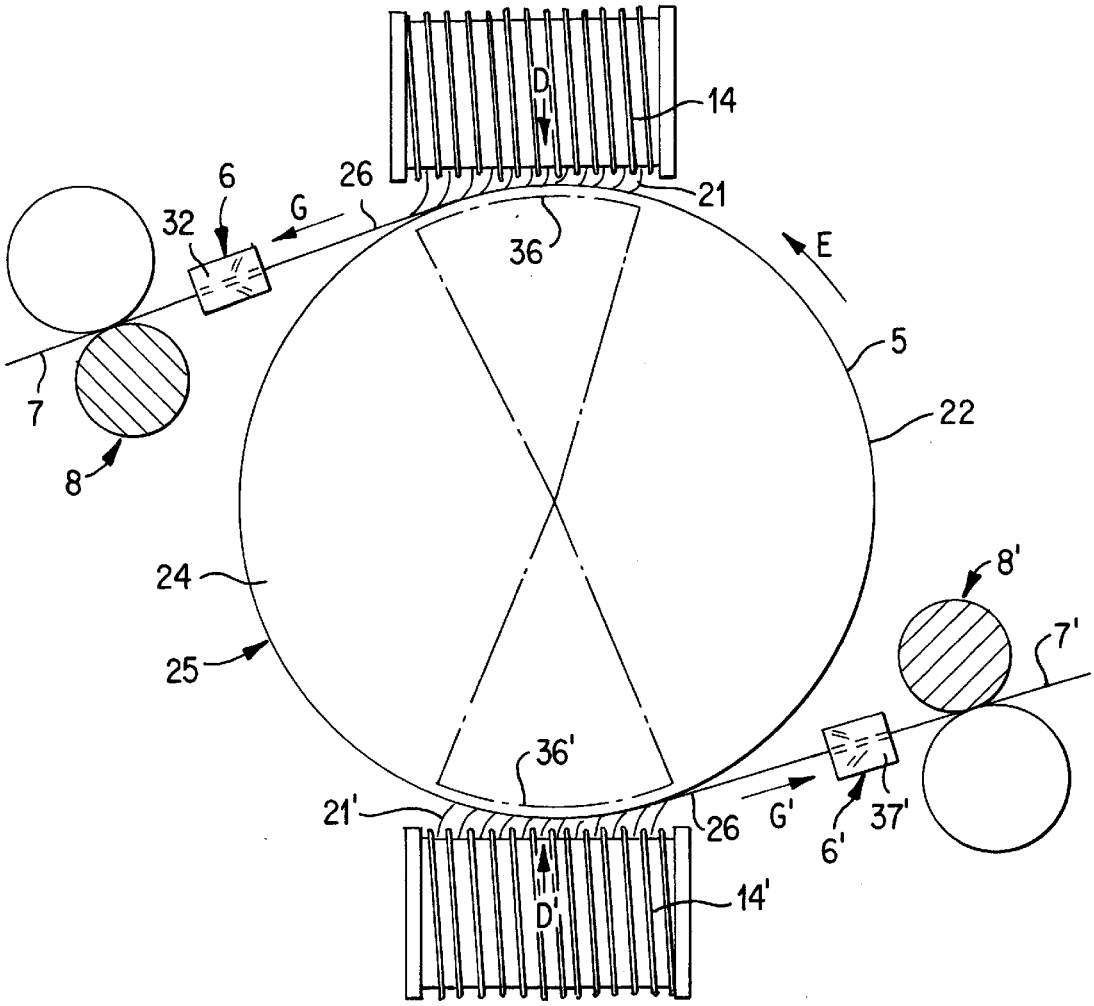
FIG. 4 is a view similar to FIG. 1, showing another embodiment in which two opening devices are arranged at a collecting surface, to each of which opening devices a yarn withdrawal device is arranged.

In the embodiment in FIG. 4, the collecting surface 5 is formed again by the circumferential surface 22 of a large disc 24, which can be relatively narrow. Diametrically opposite to the collecting surface 5, two opening rollers 14 and 14' are arranged, to each of which a withdrawal device 8 and 8' is arranged. Thus two yarns 7 and 7' are formed by means of one single collecting surface 5.

The moving directions D and D' of the respective fiber veils 21 or 21' extend transversely to the circumferential direction E of the collecting surface 5. The circumferential surface 22 is hereby disposed in very close proximity to the respective fiber beard, so that the combed single fibers 4 are not excessively accelerated. The sectors of the suction areas 36 and 36', denoted by dot-dash lines, are here very short in circumferential direction. The yarns 7 and 7' are withdrawn from the collecting surface 5 directly after the appearance of the fiber veils 21 or 21' thereon, and are twisted by the respective air nozzle 37 or 37'.

Figure 5:
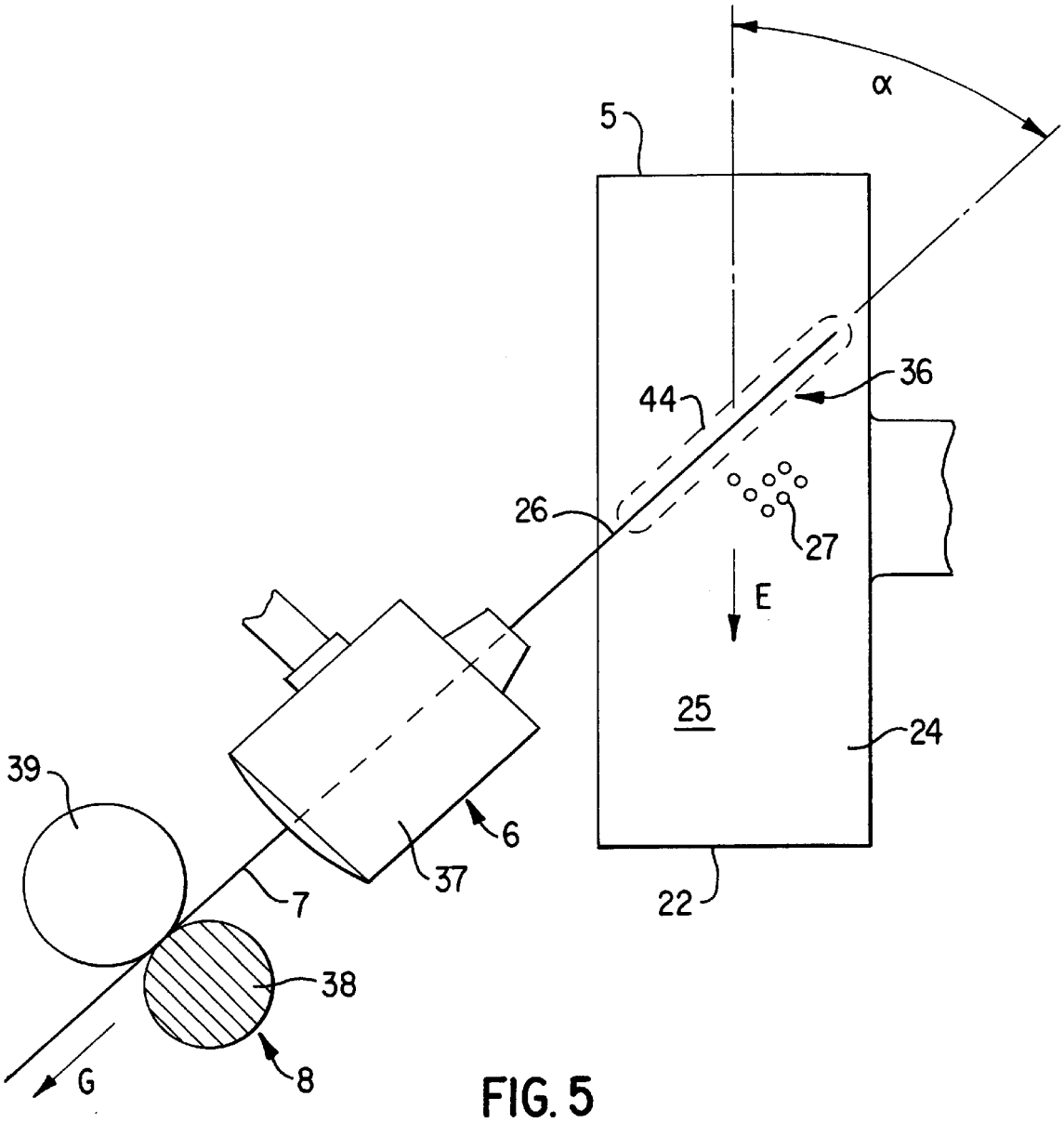
FIG. 5 is a partial view similar to FIG. 2 of another embodiment of the present invention with a collecting surface and a yarn withdrawal device, with a yarn withdrawal taking place transversely to the collecting surface.

According to the embodiment in FIG. 5, the yarn 7 is withdrawn transversely at an, angle $\alpha$ to the circumferential direction E of the collecting surface 5. With this slanted yarn withdrawal at an angle $\alpha$, the circumferential surface 22 of the disc 24 aids the twisting of the yarn 7 and also the transport thereof. If the angle $\alpha$ is enlarged, the yarn withdrawal tension is increased; if the angle $\alpha$ is reduced, the yarn tension is also reduced. The air nozzle 37 of the twist device 6 is arranged laterally, namely at a short distance from the disc 24. By turning the suction insert 34 (not shown), from which the suction slit 44 is recognizable, the yarn withdrawal force can be regulated.

As the suction slit 44 is arranged in a slanted position, the effective width of the disc 24 must in this case be somewhat wider.

Figure 6:
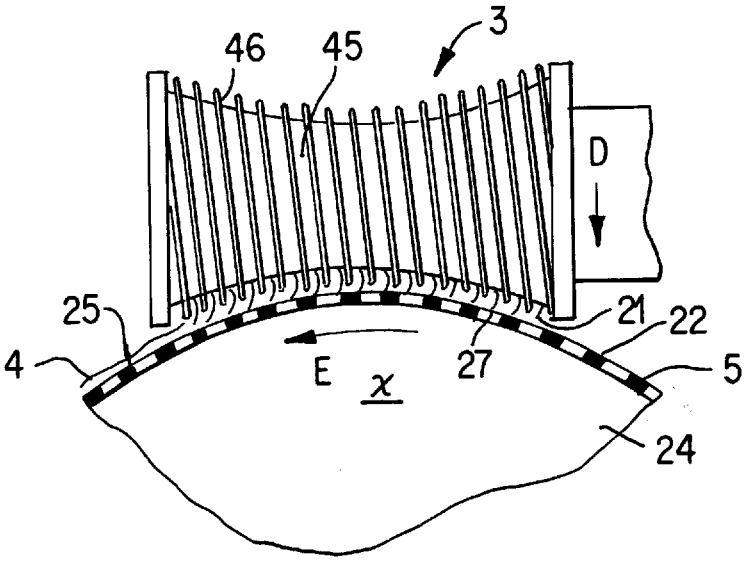
FIG. 6 is a partial view similar to FIG. 1 of another embodiment of the present invention, wherein the contour of an opening roller matches the curve of the collecting surface.

In an embodiment according to FIG. 6, an opening roller 45 is provided, whose contours and combing structure 46 are adapted to the curve of the collecting surface 5. Thus the single fibers 4 of the fiber veil 21 each have the same path to the circumferential surface 22 of the disc 24. The collecting surface 5 is again disposed in close proximity to the fiber beard 16, the circumferential direction E running transversely to the moving direction D of the fiber veil 21. The circumferential speed of the collecting surface 5 is, however, greater than the arrival speed of the single fibers 4 at the circumferential surface 22.

Figure 7:
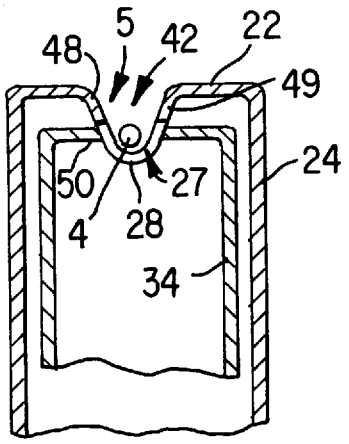
FIG. 7 is a partial view similar to FIG. 2 of another embodiment of the present invention, wherein the collecting surface has lateral guiding surfaces.

In the embodiment according to FIG. 7, the circumferential surface 22 of the disc 24 which forms the collecting surface 5 is bordered by lateral guiding surfaces 48 and 49. Thus a V-shaped groove 47 arises, in which the perforation 27 extends in the form of slits 28 disposed transversely to the circumferential direction E. Slits 28 extending over the effective width are often more effective than the usual round-hole perforation.

Figure 8:
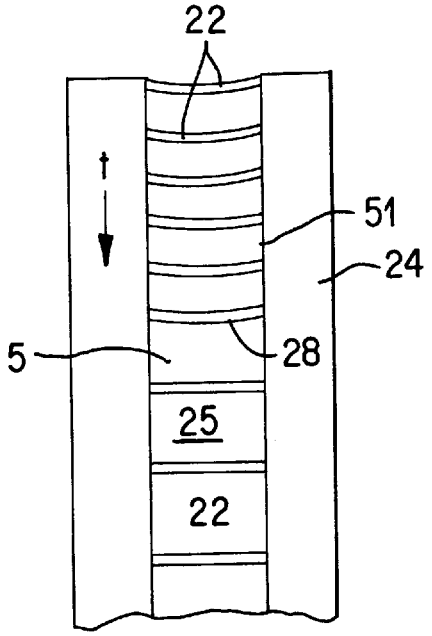
FIG. 8 is a view similar to FIG. 7 of another embodiment of the present invention, with perforation slits arranged transversely to the circumferential direction.

In the embodiment in FIG. 8 the groove 51 is very shallow, so that there are hardly any lateral guiding surfaces.

The perforation 27 is, however, also here in the form of slits 28 disposed transversely to the circumferential direction E.

Figure 9:
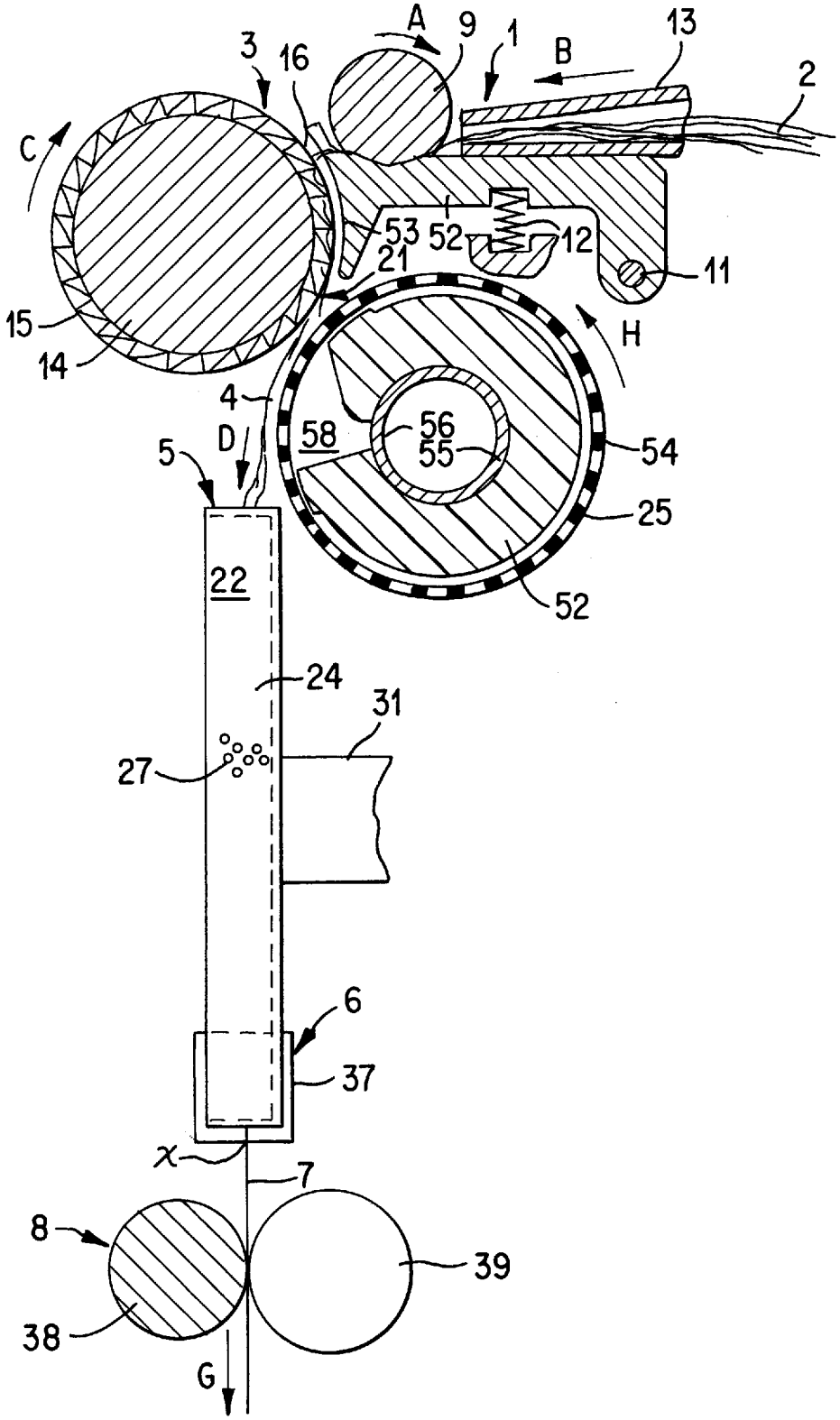
FIG. 9 is a view similar to FIG. 2 of another embodiment of the present invention, wherein between the opening device and the collecting surface a transfer roller is provided.

The embodiment in FIG. 9 differs from the other embodiments described above essentially in that the transport surface 25, placed in close proximity to the fiber beard 16, is not simultaneously the collecting surface 5, but rather is formed by a separate transfer roller 54.

The feed device 1 comprises a feed table 52, in which the fiber beard support 53 is integrated. Otherwise the feed device 1 is constructed identically to the embodiment in FIGS. 1 and 2.

Closely adjacent to the opening roller 14, a transfer roller 54 is disposed parallel to the axis thereof, whose moving direction H runs in the opposite direction to the rotational direction C of the opening roller 14. The combed single fibers 4 are first disposed on the circumferential surface of the transfer roller 54 in the form of fiber veil 21 expanding transversely to the moving direction H, and then fed to the collecting surface 5, which is formed by the circumferential surface 22 of a rotating disc 24. The single fibers 4 arrive at the collecting surface 5 in a moving direction D, which runs transversely to the circumferential direction E of the collecting surface 5.

The device is identically constructed, from the collecting surface 5 to the withdrawal device 8, to the embodiment in FIGS. 1 and 2.

The transfer roller 54 is supported on a suction tube 55, which comprises a suction slit 56, which is extended by a suction insert 57. Thus a suction area 58 is formed, which extends approximately from the fiber beard 16 to the area of the collecting surface 5, where the fiber veil 21 is transferred from the transfer roller 54 to the collecting surface 5. As the circumferential direction E of the collecting surface 5 runs transversely to the moving direction D of the fiber veil 21, the single fibers 4 land on the circumferential surface 22 of the disc 24 axially staggered. This is favorable for lessening the effect of any drafting errors which may have been caused by the opening roller 14.

The advantage of the embodiment in FIG. 9 lies in particular therein, that the single fibers 4 are at first transported at a controlled speed by the transport surface 25 formed by the transfer roller 54, before they are finally taken up by the collecting surface 5. Between the transfer roller 54 and the collecting surface 5 arises a further short draft. The collecting surface 5 transports the single fibers 4 to the yarn formation line 6, from which they are tangentially withdrawn.

Figure 10:
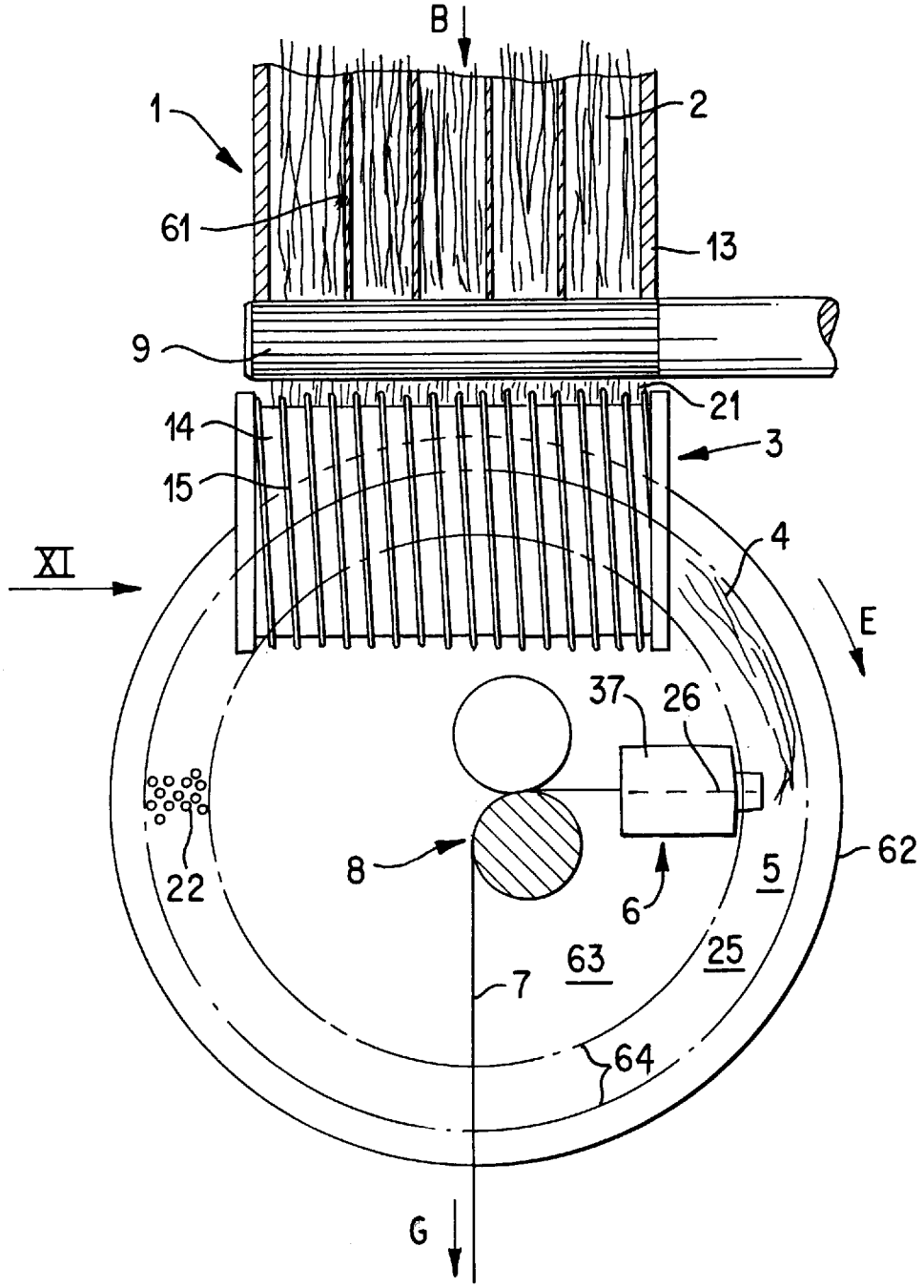
FIG. 10 is a view similar to FIG. 1 of another embodiment of the present invention, wherein a collecting surface is provided in the form of a ring surface on the front side of a rotating disc.
Figure 11:
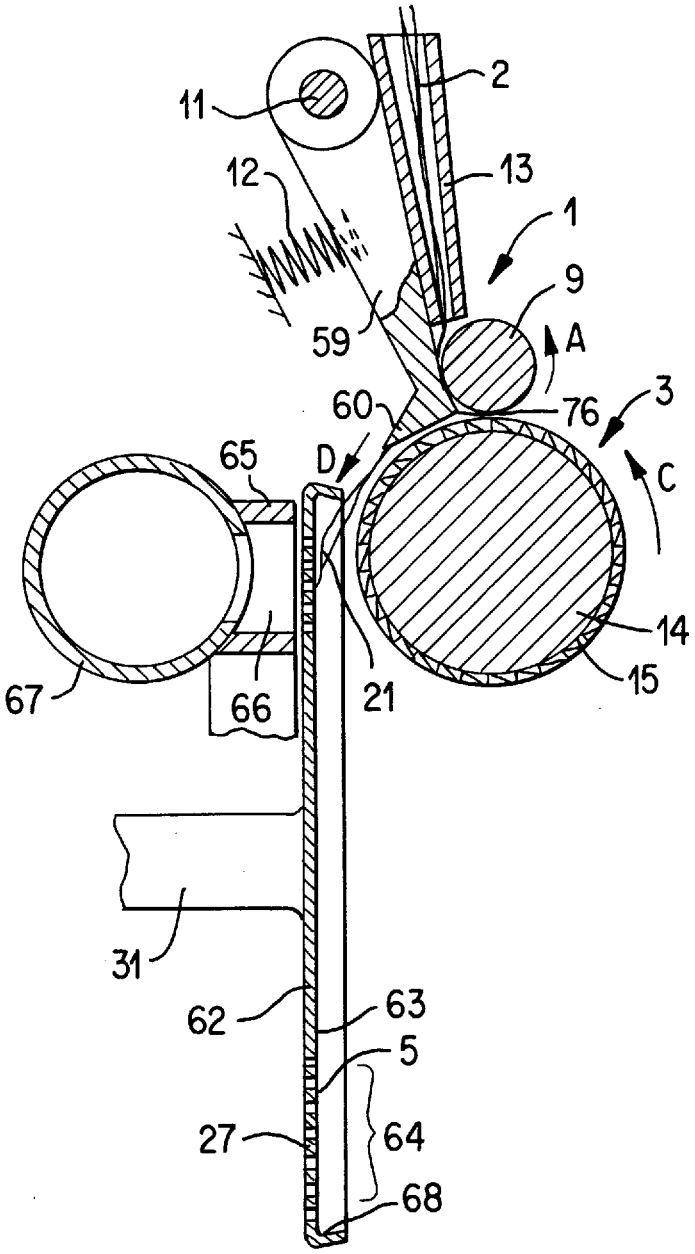
FIG. 11 is a view in arrow direction XI of FIG. 10.

In the embodiment according to FIGS. 10 and 11 the collecting surface 5 takes the form of an air-permeable suctioned ring area 64 on a front and face side 63 of a rotating disc 62.

In this embodiment, a feed table 59 is also arranged at the feed roller 9, on which feed table 59 the fiber beard support 60 is arranged for pressing the fiber beard 16 to the combing structure 15 of the opening roller 14.

Differing from the embodiments described above, the collecting surface 5 is not formed by the periphery of a disc, but rather applied on the front end face side thereof. The ring area 64 affected by a vacuum is denoted by two dot-dash concentric circles in FIG. 10. This ring area 64 can be sunk somewhat in relation to the rest of the end face surface. The edge of the disc 62 can have, as shown in FIG. 11, a lateral border 68.

In this embodiment, the circumferential speeds along the ring area 64 are not the same. The single fibers 4 deposited on the collecting surface 5, have the tendency to wander towards the larger circumference. This can be prevented by the suction box 65, whose suction opening 66 corresponds to the width of the ring surface 64. The suction box 65 is connected to a vacuum tube 67.

As can be seen in FIG. 10, the single fibers 4 deposited on the collecting surface 5 are withdrawn at the yarn formation line 26 transversely to their current transport direction through the air nozzle 37 by means of the withdrawal device 8. Due to the deflection of the single fibers 4 at the air nozzle 37, a certain tautness of the yarn 7 arises. Embodiments are also contemplated with the air nozzle 37 arranged tangentially to the circumferential direction E.

As can be seen in FIG. 10, the feed condenser 13 is provided over its effective width with a plurality of guiding surfaces 61, which separate the slivers 2 from one another. Thus cross flows in the air supply are avoided to great extent.

Figure 12:
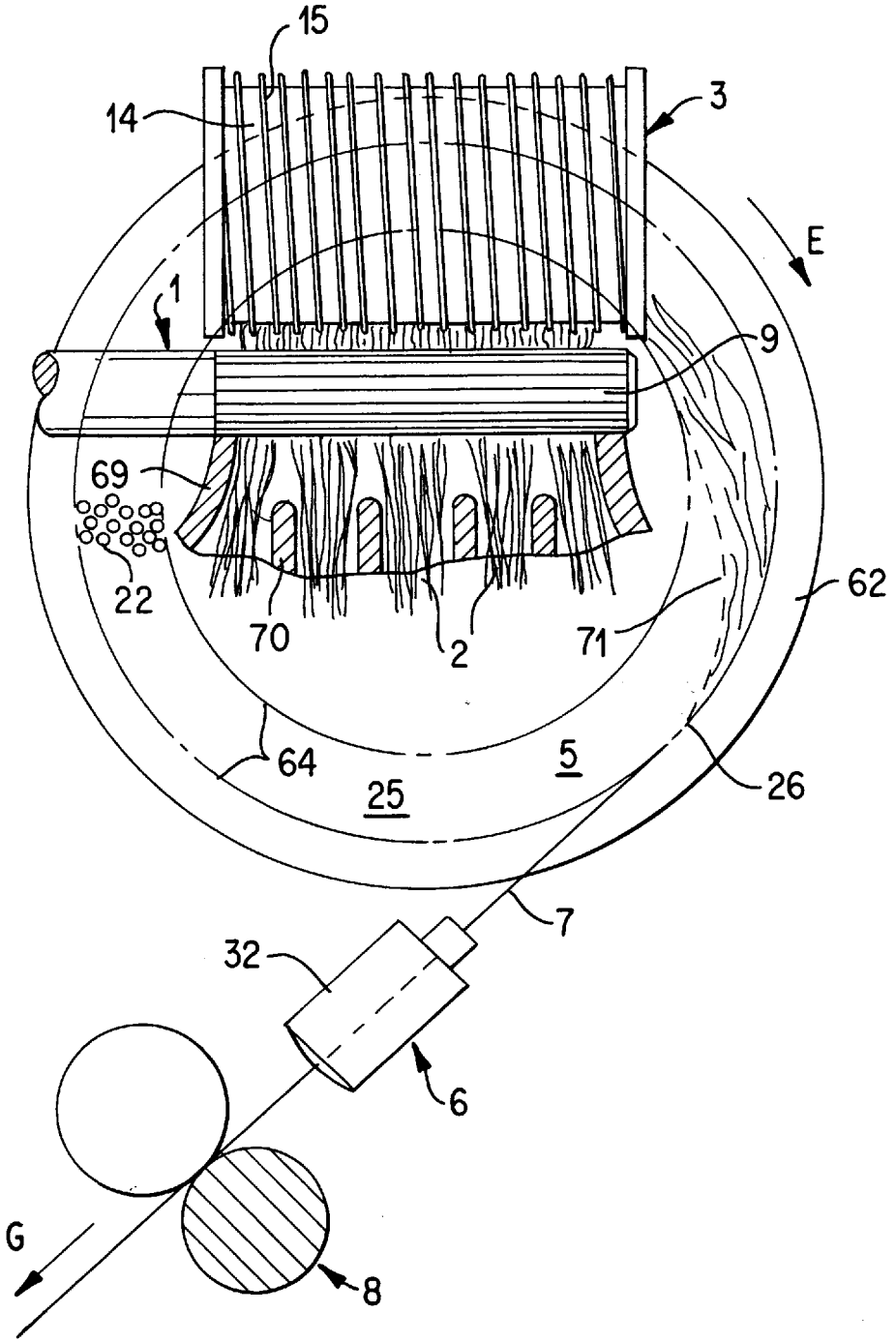
FIG. 12 is a view similar to FIG. 10 of another embodiment of the present invention, with tangential yarn withdrawal.

The embodiment in FIG. 12 corresponds to a great extent to the embodiment in FIGS. 10 and 11, whereby the feed condenser 69 and the feed roller 9 are, however, arranged over the central area of the rotating disc 62. The guiding surfaces 70 can be seen, which keep the individual slivers 2 apart from each other, but which however do not reach to the feed roller 9, as there the individual slivers 2 are joined together in a single wide sliver.

Differing from FIGS. 10 and 11, in the embodiment in FIG. 12, the suction area 64, denoted by a dot-dash line, is determined by a suction edge 71, which gradually approaches the outer radius in circumferential direction E. The single fibers 4, expanded over the ring surface 64, are thus forced to the outer periphery of the ring surface 64, so that a yarn forms in this peripheral area, which yarn is withdrawn tangentially by the withdrawal device 8. This embodiment corresponds to a large extent to the prior art mentioned above, but with the difference, however, that, according to the present invention, the collecting surface 5 in the embodiment in FIG. 12 is disposed in close proximity to the fiber beard 16, so that the single fibers 4 are not accelerated excessively before they are taken up by the collecting surface 5.

Figure 13:
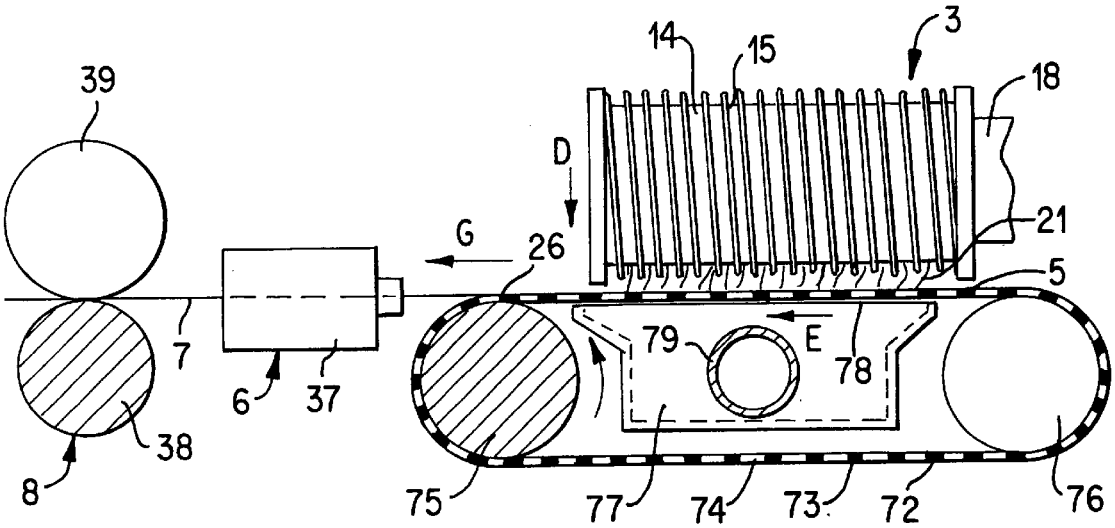
FIG. 13 is a side view of another embodiment of the present invention, in which the collecting surface is provided in the form of a rotating sieve belt.

The device in FIG. 13 comprises a collecting surface 5, which is formed by the surface 72 of an air-permeable suctioned sieve belt 73. The surface 72 is provided with a perforation 74 for this purpose. In order that the perforation 74 does not deviate either from the norm at the seam of the endless sieve belt 73, the perforation 74 is applied only after the previously blank sieve belt 73 has been made.

The sieve belt 73 runs over two guiding rollers 75 and 76, of which the guiding roller 75 is driven, so that the single fibers 4 arriving on the sieve belt 73 are transported in withdrawal direction G, which in this case corresponds to the circumferential direction E of the sieve belt 73. The sieve belt 73 is provided with a take-up surface, which is longer than the effective width of the opening roller 14. The circumferential direction E of the sieve belt 73 runs transversely to the current moving direction D of the fiber veil 21 arriving at the collecting surface 5. The collecting surface 5 is in accordance with the present invention, disposed in close proximity to the fiber beard 16, in order that the single fibers 4 are not excessively accelerated before they are taken up by the sieve belt 73.

In the inside of the endless rotating sieve belt 73 there is a suction box 77, which faces the take-up area of the fiber veil 21 with a suction opening 78. The suction box 77 is connected to a vacuum tube 79.

In this embodiment it is also important that the withdrawal speed of the yarn 7 at the yarn formation line 26 is not excessively high, that is, it is within controllable limits. As the single fibers 4 are continuously accelerated somewhat during the spinning process, the starting speed must be sufficiently low. For this reason the single fibers 4 must be taken up directly downstream of the fiber beard 16, before they reach an excessive speed. Standard opening rollers with fiber feed channel are thus less suitable for the spinning process.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning process for making yarn, comprising:

opening at least one sliver on an opening device to form a fiber veil of individual fibers arranged side by side and transported in a first direction, transferring said fiber veil from the opening device to a moving surface immediately after separation of said individual fibers from the at least one sliver and before said fibers are accelerated by the opening device to a speed approaching the speed of the opening device, transporting said fiber veil in a second direction transverse to said first direction to a yarn formation line, twisting the fibers at the yarn formation line to form a yarn, and withdrawing the yarn, wherein the speed of the fibers from opening to withdrawing the yarn is continuously increased.

2. A process according to claim 1, wherein said transporting said fiber veil in a second direction includes transporting said fiber veil on a moving collecting surface to said yarn formation line.

3. A process according to claim 2, wherein the yarn is withdrawn tangentially to the circumferential direction of the collecting surface.

4. A process according to claim 3, wherein the yarn is withdrawn from the collecting surface immediately after the fiber veil has reached the collecting surface.

5. A process according to claim 2, wherein the yarn is withdrawn transversely to the second direction.

6. A process according to claim 5, wherein the yarn is withdrawn from the collecting surface immediately after the fiber veil has reached the collecting surface.

7. A process according to claim 2, wherein said moving surface is a suctioned transport surface of a transport device, and wherein said transport surface also functions as said collecting surface.

8. A process according to claim 7, wherein the yarn is withdrawn tangentially to a circumferential direction of the collecting surface.

9. A process according to claim 7, wherein the yarn is withdrawn transversely to the second direction.

10. A process according to claim 7, wherein said collecting surface is a rotating surface.

11. A process according to claim 2, wherein said moving surface is a suctioned transport surface of a transport device, and wherein said collecting surface is separate from the transport surface, and comprising transferring the individual fibers from the transport surface to the collecting surface.

12. A process according to claim 11, wherein the yarn is withdrawn tangentially to the circumferential direction of the collecting surface.

13. A process according to claim 11, wherein the yarn is withdrawn transversely to the second direction.

14. A process according to claim 11, wherein said collecting surface is a rotating surface.

15. A process according to claim 2, wherein said moving surface is a suctioned transport surface of a transport device.

16. A process according to claim 15, wherein said collecting surface is a rotating surface.

17. A process according to claim 2, wherein said collecting surface is a rotating surface.

18. A process according to claim 1, wherein said moving surface is a suctioned transport surface of a transport device.

19. An open-end spinning apparatus for making yarn, comprising:

an opening device for opening at least one sliver to form a fiber veil of individual fibers arranged side by side and transported in a first direction, transfer structure for transferring said fiber veil from the opening device to a moving surface immediately after separation of said individual fibers from the at least one sliver and before said fibers are accelerated by the opening device to a speed approaching the speed of the opening device, transporting structure for transporting said fiber veil in a second direction transverse to said first direction to a yarn formation line, a twisting device for twisting the fibers at the yarn formation line to form a yarn, and a yarn withdrawal device for withdrawing the yarn, wherein the speed of the fibers from opening to withdrawing the yarn is continuously increased.

20. Apparatus according to claim 19, wherein said transporting structure includes a moving collecting surface for transporting said fiber veil to said yarn formation line.

21. Apparatus according to claim 20, wherein the collecting surface is a surface of an air-permeable suctioned sieve belt.

22. Apparatus according to claim 20, wherein the collecting surface is an air-permeable suctioned ring area on an end side of a rotating disc.

23. Apparatus according to claim 22, wherein a transfer roller is arranged upstream of the collecting surface, the moving direction of said transfer roller running transversely to the circumferential direction of the collecting surface.

24. Apparatus according to claim 20, wherein the collecting surface is an air-permeable suctioned peripheral surface of a roller-like rotating disc.

25. Apparatus according to claim 20, wherein a transfer roller is arranged upstream of the collecting surface, the moving direction of said transfer roller running transversely to the circumferential direction of the collecting surface.

26. An apparatus according to claim 20, wherein the collecting surface is bordered by lateral guiding surfaces.

27. An apparatus according to claim 20, wherein the collecting surface is provided with a perforation in the form of slits disposed transversely to a circumferential direction of the collecting surface.

28. An apparatus according to claim 20, wherein an air nozzle, forming an extension of the yarn formation line, is arranged downstream of the collecting surface.

29. A process for open-end spinning comprising:

opening at least one sliver to form a fiber veil of single fibers, feeding said single fibers to a collecting surface rotating in transverse direction with respect to a feeding moving direction of said single fibers, and withdrawing the fibers from the collecting surface along a yarn formation line to form twisted yarn, before completion of a single revolution of the collecting surface, wherein said single fibers are never slowed at any point as they travel from the at least one sliver to the yarn, wherein said single fibers are subject to an exactly predetermined mechanically controlled speed immediately after they are opened from the sliver, wherein the single fibers are taken up by a suction transport device immediately after being separated from the sliver, and wherein the single fibers are transferred to a separate collecting surface from a transport surface of the transport device.

30. Apparatus for open-end spinning comprising:

a sliver opening device which produces a fiber veil of single fibers from at least one sliver, a rotating collecting surface accepting said fiber veil, said collecting surface moving in a direction transverse to a direction of movement of the fiber veil from the opening device, and a withdrawal device withdrawing the fibers from the collecting surface along a yarn formation line to form twisted yarn, at a position of said collecting surface less than a single revolution from a position where said fiber veil is accepted, wherein said opening device, collecting surface and withdrawal device are configured to assure that said single fibers are not slowed down at any point as they travel from the at least one sliver to the withdrawal device and to subject said single fibers to a precisely predetermined mechanically controlled speed starting immediately after they are opened by the opening device, and wherein a transfer roller is arranged upstream of the collecting surface, the moving direction of said transfer roller running transversely to the circumferential direction of the collecting surface.

* * * * *